United States Patent [19]

Norris et al.

[11] 3,985,927

[45] Oct. 12, 1976

[54] COMPOSITIONS AND METHOD FOR PRODUCING A CHEMICAL WATERMARK ON FINISHED PAPER PRODUCTS

[75] Inventors: Terry O. Norris; Rolland A. Aubey, both of Port Edwards; John E. Haug, Rhinelander, all of Wis.

[73] Assignee: Nekoosa Edwards Paper Company, Inc., Port Edwards, Wis.

[22] Filed: Feb. 24, 1975

[21] Appl. No.: 552,153

[52] U.S. Cl. ..... 428/211; 162/110; 427/43; 427/288; 427/391

[51] Int. Cl.[2] ..... B41M 7/00; D21H 1/48; D21H 5/00

[58] Field of Search ..... 162/110; 428/211; 427/43, 288, 391; 96/35.1, 115 P; 8/DIG. 18

[56] References Cited

UNITED STATES PATENTS

| | | | |
|---|---|---|---|
| 3,140,959 | 7/1964 | Vaurio | 428/211 |
| 3,288,628 | 11/1966 | Schur et al. | 428/211 |
| 3,486,923 | 12/1969 | Skofronick | 162/110 |
| 3,551,246 | 12/1970 | Bossemir et al. | 428/211 |

*Primary Examiner*—J.C. Cannon

*Attorney, Agent, or Firm*—Hill, Gross, Simpson, Van Santen, Steadman, Chiara & Simpson

[57] ABSTRACT

Compositions and method for producing chemical watermarks in finished paper products, the watermarks being produced by applying to the surface of the paper a synthetic resin composition having a chemical grouping therein capable of being insolubilized upon exposure to high frequency radiation, and thereafter exposing the resin composition to such high frequency radiation to insolubilize the resin.

16 Claims, No Drawings

COMPOSITIONS AND METHOD FOR PRC ᴵUCING A CHEMICAL WATERMARK ON FINISHED PAPER PRODUCTS

BACKGROUND OF THE INVENTION

1. Field of the Invention

This invention is in the field of chemical watermarks, i.e., marks that are laid down upon paper products to provide a characteristic design to convey intelligence.

2. DESCRIPTION OF THE PRIOR ART

In the office operations of commercial enterprises, it is often desirable to have writing stationery and other forms of business and professional papers provided with a watermark. These watermarks are sometimes business trandemarks used to identify the manufacturer of the paper product or they may contain coded information that relates to dates of manufacture or composition. Sometimes business trademarks are watermarked for identity and protective purposes and as an additional means of distinctively identifying a particular business enterprise.

The usual practice of watermarking is performed mechanically during the papermaking process by providing rolls with raised designs interposed usually at a point before the wet paper web enters the driers. The fibers in the web are displaced in the horizontal direction and the paper is rendered thinner and consequently denser and more transparent in the area of the watermark when viewed under transmitted light. Thus, the embossed rolls form a configuration or design of the mark in the damp or wet paper which remains permanent upon drying. After the papermaking and watermarking process is complete, the finished paper may be cut into sheets of various sizes, for use as stationery or business papers of the like.

Another known method of mechanically producing a watermark involves employing a band fitted about a roll and carrying the design or configuration of the watermark in relief. The design of the mark in relief on the band is brought into contact with the wet paper web at the wet presses beyond the Fourdrinier wire. At that point the paper is still plastic and compresses readily. The resulting compression of fibers reduces entrapped air and light refraction, and increases the transparency in the area conforming to the configuration of the watermark.

Mechanically produced watermarked paper has several disadvantages. For one, the commercial papermaking machines are very large and produce paper at a high rate of speed so that for reasons of economy a customer desiring paper bearing a private watermark must purchase a relatively large amount of each kind of paper needed. This, of course, limits such privately watermarked papers to a few but relatively large industrial users or governmental departments since it is apparent that smaller enterprises could not economically purchase and stock such large supplies of paper products. Secondly, the cost of the embossed or banded rolls for the papermaking machine is obviously extremely high and could not, therefore, be afforded by smaller industrial users. Third, the cost of setting up the embossed or banded rolls involves both labor as well as the loss of production on the papermaking machinery and would have to be included in the net cost to the purchaser. Among other disadvantages, the purchaser finds that his private watermark is not positioned uniformly in the finished cut stationery unless he assumes the additional labor cost and paper waste involved in constantly positioning the relative position of the rolled paper and the cut-off knife. While private watermarks may be formed by the mechanical methods outlined above, it is thus clear that orders for paper products so marked must be large if the cost thereof is to be economically justified, so that orders in small quantities are of such high cost as to be rarely justified.

There have been some disclosures of application of chemical watermarks to otherwise finished paper products. Generally, these processes have in common the steps of applying a chemical material in the form of a solution in a volatile solvent to the otherwise finished paper product, allowing or otherwise causing the solution to penetrate into the fiber structure of the sheet, and then removing the volatile solvent. The solvent may be removed by evaporation or normal drying at ambient temperatures or by forced drying with the application of heat or forced air streams. One of the earliest of such disclosures appears in Livingstone U.S. Pat. No. 3,048,100 which is directed specifically to a chemical watermark produced by treating the paper with a cyclohexanone resin dissolved in a volatile solvent.

Vaurio U.S. Pat. No. 3,085,898 to an impregnating solution containing about 30 to 70% by weight of either sucrose acetate butyrate, sucrose acetate isobutyrate or an alkali metal salt of a dialkyl sulfosucinate dissolved in an inert organic solvent for chemical watermarking.

Vaurio U.S. Pat. No. 3,140,959 refers to the use of synthetic, thermosetting, curable resins in solution in volatile organic solvents in the formation of chemical watermarks. In one embodiment of the invention, up to 60% by weight of curing agents for the thermosettable resin are employed to render the resin insoluble in water and common solvents. In another embodiment of the invention, prehardened synthetic thermosetting resins in solution in volatile organic solvents are utilized to form the chemical watermark.

Schur U.S. Pat. No. 3,288,628 describes a chemical water-marking process employing a liquid organic viscous ester having a molecular weight in the range of about 300 to 10,000 in combination with a monomeric non-volatile liquid organic ester plasticizer.

Skofronick et al. U.S. Pat. No. 3,293,062 describes the use of a curable hexamethoxymethyl melamine and a sulfonic acid derivative as a curing agent in the formation of chemical watermarks. The watermark products of this invention generally require 5 to 15 days aging at ambient temperatures in order to render the watermark insoluble in water, ethanol or other common solvents.

While the disclosures mentioned above can be used to produce chemical watermarks, many of them have disadvantages of their own. Some produce watermarks which are leachable from the paper, or become smeared, or otherwise distorted by the action of water or chemical solvents on the paper products containing such watermarks. Since a variety of printing inks and printing processes in common use today utilize water and chemical solvents in their operation, they present the possibility of attacking such watermarks, distorting their original form, and adversely affecting their distinctiveness.

In some cases, the processes employed make use of curing agents which are noxious and unpleasant chemical compounds or give rise to unpleasant and noxious vapors or byproducts upon being heated to effect the curing reaction. In some instances, the curing agents are vesicants and skin sensitizing agents which must be handled with extreme care to avoid chemical burns or contact dermatitis. In other cases, the compositions require excessively long periods of time for the curing reaction to occur so that the chemical watermark so produced would not be undesirably altered by contact with water or common organic solvents. In some instances, the curing agents are highly acidic compounds which could tend to lower the strength properties of the paper in the area of the watermark upon long-term aging or exposure to higher than normal temperatures. This type of degradation is normally accompanied by embrittlement and loss of physical strength characteristics. The curing reaction which renders the watermark insensitive to the water and common solvents may be effected in a shorter time span if the paper is heated to an elevated temperature after application of the chemicals but the obvious increased cost and increased degree of control which must be exercised over this type of process makes this option expensive and disadvantageous.

SUMMARY OF THE INVENTION

The present invention provides a composition and process for forming a chemical watermark in otherwise finished paper and at the same time overcomes the disadvantages associated with previous types of chemical watermarking. The present invention provides chemical watermarks which are substantially insoluble and colorless. It provides a method for making chemical watermarks which involves applying a liquid chemical composition to the surface of otherwise finished paper and then curing the composition in the paper to render it insoluble to water and common solvents. The method and composition of the present invention make watermark paper economically available in large or small quantities. The process of the present invention can be carried out substantially at room temperature to thereby eliminate any necessity of involved procedural steps or elevated temperature cures. The chemical watermark of the present invention is formed by replacing air entrained in a paper sheet with a material having an index of refraction reasonably close to that of cellulosic fibers. The chemical watermarks of the present invention are substantially insoluble, do not have excessive gloss, are colorless, can survive under long-term aging, have good ink receptivity and the like, and do not damage the finished paper.

In summary, the watermark of the present invention is produced by applying a selected design by means of generally liquid compositions containing synthetic resins, all characterized by the presence of a chemical grouping capable of initiating a crosslinking or insolubilizing reaction when exposed to high frequency radiation, i.e., radiation above the visible spectrum. In the preferred form of the present invention, we apply a synthetic resin composition which includes a free radical polymerizable polyethylenically unsaturated monomer or prepolymer and preferably a thermally stable photoinitiator which, upon exposure to a radiating source rich in ultraviolet light quickly reacts to form an insoluble polymer having an index of refraction closely approximating that of the cellulose fibers.

DESCRIPTION OF THE PREFERRED EMBODIMENTS

The composition and method of the present invention involve the use of radiation curable compositions containing photopolymerizable groups which are known, per se, in the prior art. It is known that such compositions can be prepared for use as coating materials, inks, and the like and consist of photopolymerizable materials containing radiation sensitive groups. When such compositions are exposed to actinic energy, they are converted to substantially insoluble polymers. When certain photoinitiators are added to these compositions, they polymerize at a vastly improved rate when exposed to actinic energy. The photopolymerizable materials may be modified by the inclusion of compatible polymerizable materials to improve the mechanical properties important to their use. For example, compatible materials which are co-reactive with the photopolymerizable materials in the presence of oxygen or chain transfer agents, for example, materials capable of chain propagation, may be added to the photopolymerizable compositions.

Usable photopolymerizable compositions include free radical polymerizable polyethylenically unsaturated monomers or prepolymers such as acrylic acid esters, the methacrylic acid esters, and the itaconic acid esters of aliphatic polyhydric alcohols and specifically the esters of pentaerythritol, dipentaerythritol, and polypentaerythritols, etc., with at least 2 moles of acrylic, methacrylic, or itaconic acid. Specific examples include, but are not limited to, pentaerythritol diacrylate, pentaerythritol triacrylate, dipentaerythritol triacrylate, pentaerythritol tetraacrylate, dipentaerythritol diacrylate, dipentaerythritol tetraacrylate, dipentaerythritol pentaacrylate, dipentaerythritol hexacrylate, tripentaerythritol octoacrylate, and the like; prepolymers of these esters, for example, dimers, trimers, and other oligimers, and mixtures and copolymers thereof; as well as mixtures of the monomers and prepolymers. The compositions described in U.S. Pat. No. 3,551,246 assigned to Sun Chemical Corporation are examples of photopolymerizable compositions useful in the practice of the present invention, and the disclosure of that patent is incorporated herein by reference.

The photopolymerizable compositions of the present invention may and preferably do contain photoinitiators or sensitizers composed of such materials as thermally stable peroxides or acyloins or derivatives thereof, such, for example, as benzoin methylether, benzoin ethylether, desyl bromide, desyl chloride, desyl amine, and the like or mixtures thereof. The factors varying the rate at which photopolymerizable compositions will cure to a substantially insoluble state include but are not limited to the specific ingredients in the composition, concentration of the photoinitiators, thickness of the material, nature and intensity of the radiation source and its distance from the materials, the presence or absence of oxygen, and the ambient temperature.

Any suitable source of radiation may be used, for example, a 100 watt per inch Hanovia high pressure mercury arc quartz ultraviolet lamp or a larger ultraviolet source of high wattage.

The present invention also comtemplates the use of radiation sources which do not generate ultraviolet light such, for example, as linear electron accelerators, gamma radiation emitters, such as cobalt 60, or other suitable electron beam generators.

There are a wide variety of commercially available radiation sensitive compositions which may be used in the practice of the present invention. For example, there are the "Photozid" polymers (sulfonylazido polymers) manufactured and sold by the Upjohn Company, compositions known as the "Uvimers" and "Flexomers" manufactured and sold by the Polychrome Corporation, photopolymerizable polyurethanes as manufactured and sold by the Davison Chemical Division of the W. R. Grace Corporation, photopolymerizable monomer/polymer syrups as manufactured and sold by the Rohm and Haas Corporation, and the photopolymerizable unsaturated polyester resins manufactured and sold by the Sun Chemical Corporation under the trade name "Sun Cure Resins." Any of a variety of well known ethylenically unsaturated materials which are co-reactive with the above-mentioned photopolymerizable compositions may also be utilized in the compositions used in the practice of the present invention.

The compositions of the present invention can be synthesized or chemically tailored by selection of the feed monomers to have a desired refractive index to that of cellulose. Since the refractive index of a chemical substance or mixture of substances is an additive property of the refractive indices of the various materials of which it is composed, selecting the proper combination of high and low refractive index monomers can give rise to a synthetic polymer having precisely the desired refractive index.

Further, the polymerization process used to prepare the synthetic polymers of this invention can be easily controlled to achieve precisely the viscosity necessary for optimum practice of the invention. Ideally the solution viscosity of the watermark composition will be low enough to permit easy handling and penetration of the resin into the spaces between the fibers and fillers of the paper in a reasonable time after application and yet be of sufficient viscosity such that their migration into the pores of the paper outside the area of the chemical watermark design cannot occur prior to the crosslinking reaction which renders the watermark substantially insoluble.

Additionally, the precise degree of crosslinking functionality necessary to cure the materials to a state that is substantially insoluble in water and common solvents while remaining below the level that would render the crosslinked polymer inflexible and brittle in the paper sheet can be synthesized or tailored into the synthetic resin. Since the curing reaction initiated by ultraviolet radiation cures the materials of this invention by chain growth polymerization, only solvents and no byproducts have to be vented from the crosslinking reaction. The compositions of the present invention can be utilized in conjunction with common solvents such as water and alcohol without resorting to exotic, expensive, or toxic materials.

Reaction catalysts and monomer and pre-polymer compositions are selected so that the crosslinking reaction does not occur prematurely so as to cause the resin to build up viscosity or set up on the application equipment. Similarly, the intensity and duration of the crosslinking illumination can be controlled to allow just enough radiation to reach the newly formed chemical watermark so that crosslinking and insolubilization do not occur prior to complete penetration of the chemical composition into the voids between the fiber and filler of the paper and yet so that it receives sufficient radiation to crosslink the resin into immobility and prior to detrimental migration of the material from the design area of the chemical watermark. The crosslinking radiation is accompanied by a minimum of heat and can be turned on and off at the flick of a switch.

Chemical watermarks produced by the compositions and method of this invention can be applied to either side of a paper so that either a right reading or a mirror image occurs when looking at either the wire side or the felt side of the paper.

The compositions of the invention can be easily and economically applied using commercially available printing equipment. For example, the compositions of this invention may be conveniently applied using a flexographic printing press and a soft rubber-like plate having on its surface a raised design in the configuration of the desired watermark.

As noted previously, the thickness, composition and density of the paper sheet are variables which must be considered in the coating process. However, such variables can be largely overcome by adjusting the concentration of the compositions in selected organic solvents. The selection of a proper solvent as a carrier is important since if the solvent evaporates at an excessive rate, the penetration of the resin composition into the paper is insufficient to result in proper impregnation. On the other hand, if the solvent evaporates too slowly, the resinous compositions tend to migrate too far into the paper resulting in an indistinct watermark.

Various compositions of the present invention were screened in the laboratory by hand impregnation followed by curing. Impregnation was accomplished by depositing a small metered amount, for example, 1 to 2 grams of the composition on the surface of a square plate of glass. The liquid composition was spread uniformly over the glass surface using a hand roller fitted with a handle, such as used in the application of inks to linoleum block prints. A dye or handstamp of rubber-like material, having a design or configuration raised on the face thereof corresponding to a typical watermark was pressed against the liquid film of the composition on the glass plate and then stamped on a test paper sheet. The chemical watermark paper was cured by exposure to the rays of an ultraviolet lamp.

The curing time required for the resin composition to crosslink to a degree sufficient to resist solubility in water or other common solvents was determined by agitating the paper sheet bearing the chemical watermark in the test solvent for a period of 1 to 2 minutes at room temperature. Insufficient curing of the chemical watermark could be detected by extraction of the resin (or disappearance of the chemical watermark) or by the mark becoming diffuse and migrating outside the area of its original design. When the chemical watermark remained unchanged on drying after agitation in the test solvent, this was taken as an indication that the resin had cured to a solvent resistant state. Solvent resistance tests were conducted 1 to 2 hours after exposure to the curing radiation.

Using this type of empirical testing, it was found that a 55 solution of "Sun Cure 14V25," a light curing unsaturated polyester resin manufactured and sold by the Sun Chemical Corporation, and ethyl alcohol when applied to the paper and cured completely passed the requirements laid down for curability and resistance to solvents.

The following examples illustrate compositions all of which produced excellent chemical watermarks according to this invention. Some of these compositions have been employed using commercial flexographic printing or multilith machinery for application of the watermark followed by curing of the resin using an ultraviolet lamp.

EXAMPLE 1

A clear and colorless ultraviolet radiation curing resin manufactured by the Sun Chemical Corporation and sold as "Sun Cure 14V25" was diluted with ethyl alcohol until a room temperature viscosity of 15 to 16 seconds measured with a No. 2 Zahn cup was reached, although viscosities ranging from 14 to 38 seconds are operable. A commercial scale flexographic press capable of handling webs up to 42 inches in width and equipped with a drying tunnel and sheeter following the standard flexographic printing unit was employed. The flexographic press unit and ink feed train were cleaned of all traces of residual flexographic ink. A flexible rubber-like plate bearing a raised design pattern in the configuration of the desired watermark was installed on the printing unit of the press. A high pressure mercury arc of lamp was installed on the press in such a manner that the printed sheet was exposed to the radiation from the lamp for periods of 0.3 to 1.2 seconds after the flexographic printing station but just ahead of the drying tunnel and sheeter. The paper web was fed directly from the flexographic printing station into the sheeter without going through the drying tunnel for purposes of this experiment. The clear resin solution was fed to the inking system of the press and the rolls were coated with resin in the same manner that a flexographic ink would be applied in conventional flexographic printing. The desired amount of resin solution was metered on by flooding an Anilox roll in the number range of 55 to 110 with a resin solution and metering off the excess with a doctor blade. Resin solution in the configuration of the watermark design was applied to the paper and the web containing the printed watermark design was passed under the ultraviolet lamp. The web containing the printed watermark was then fed directly into the sheeter and converted to finished paper sheets containing a clear and distinct, substantially insoluble watermark.

Both paper composed of 25% cotton fiber and 75% chemical wood pulp and 100% chemical pulp containing paper (substance 20 bond) provided excellent watermarks by this procedure. Satisfactory watermarks were obtained at web speeds of 100 to 400 feet per minute.

EXAMPLE 2

Ink and dampening solution were removed from the ink train section of a sheet fed offset press(an press (an 1850 multilith) and the ink train system was thoroughly cleaned to remove all traces of these materials. A rubber-like plate with a raised surface in the design configuration of the desired watermark was fitted into the position normally occupied by the rubber offset blanket. A non-imaged offset plate was fitted into the position normally occupied by an imaged offset plate. An ethanol solution of the polyester resin identified as "Sun Cure 14V25" was metered onto the press through the dampening system. The resin solution was transferred from the dampening system to the non-imaged plate, which in turn, transferred it to the special rubber plate bearing the raised watermark design. The resin solution image was printed onto the paper sheets in the same manner as an offset blanket transfers the ink image to paper in the conventional offset process. An ultraviolet lamp was positioned over the exit path of the paper so that sheets bearing the printed watermark were exposed to the actinic radiation of the mercury arc ultraviolet lamp. Curing of the resin, initiated by exposure to the rays of the lamp, began immediately and continued while the paper was in the printed stack so as to cure the watermark to a substantially insoluble state in a few minutes time. Excellent watermarks were produced in both paper composed of 25% cotton fiber and 75% chemical wood pulp as well as that composed of 100% chemical wood pulp.

It should be understood that changes and modifications can be made to the described embodiments which do not depart from the scope of the present invention, as defined in the appended claims.

We claim as our invention:

1. A chemically watermarked product comprising a paper sheet having a watermark of preselected design applied to a portion thereof, said watermark having a refractive index approximating that of the paper and being an insoluble reaction product produced by irradiation of a synthetic resin with high frequency radiation above the visible spectrum.

2. The product of claim 1 in which said resin composition includes a free radical polymerizable polyethylenically unsaturated monomer or prepolymer.

3. The product of claim 2 in which said synthetic resin is an ester of an aliphatic polyhydric alcohol with at least 2 mols of an unsaturated carboxylic acid containing up to five carbon atoms per molecule.

4. The product of claim 3 in which said acid is acrylic acid.

5. The product of claim 3 in which said acid is methacrylic acid.

6. The product of claim 3 in which said acid is itaconic acid.

7. The product of claim 3 in which said composition also includes a photoinitiator.

8. The method of applying a chemical watermark to paper which comprises applying to the surface of a finished paper a synthetic resin composition having a chemical grouping thereon capable of being insolubilized upon exposure to high frequency radiation, said resin composition being applied in the form of a preselected design in a preselected small area of the paper, said resin composition having a viscosity suitable for such coating and being insufficiently cross-linked to be chemically set, and thereafter exposing said resin composition to high frequency radiation above the visible spectrum to thereby insolubilize said resin composition.

9. The method of claim 8 in which said high frequency radiation is rich in ultraviolet light.

10. The method of claim 8 in which said composition also includes a photoinitiator.

11. The method of claim 8 in which said composition is applied as a solvent solution.

12. The method of claim 8 in which said synthetic resin composition includes a free radical polymerizable polyethylenically unsaturated monomer or a prepolymer.

13. The method of claim 12 in which said synthetic resin is an ester of an aliphatic polyhydric alcohol with at least 2 mols of an unsaturated carboxylic acid containing up to 5 carbon atoms per molecule.

14. The method of claim 13 in which said acid is acrylic acid.

15. The method of claim 13 in which said acid is methacrylic acid.

16. The method of claim 13 in which said acid is itaconic acid.

* * * * *

UNITED STATES PATENT AND TRADEMARK OFFICE

CERTIFICATE OF CORRECTION

PATENT NO. : 3,985,927
DATED : October 12, 1976
INVENTOR(S) : Terry O. Norris, Rolland A. Aubey & John E. Haug It is certified that error appears in the above-identified patent and that said Letters Patent are hereby corrected as shown below:

Col. 1, line 36, "of" should read --or--.

Col. 5, line 24, "close" should appear before "to" (second occurrence).

Col. 6, line 63, "55" should read --fifty-fifty--.

Col. 7, line 24 "of" should be deleted;

" line 53, "(an press" should be deleted.

Signed and Sealed this

Fifth Day of April 1977

[SEAL]

*Attest:*

RUTH C. MASON
*Attesting Officer*

C. MARSHALL DANN
*Commissioner of Patents and Trademarks*